US005816178A

United States Patent [19]

Sahl

[11] Patent Number: 5,816,178

[45] Date of Patent: Oct. 6, 1998

[54] AUTOMATIC UNLOADING AND STACKING APPARATUS

[75] Inventor: Johannes Sahl, Neuhofen a.d. Krems, Austria

[73] Assignee: Jet Sew Technologies, Inc., Bowling Green, Ky.

[21] Appl. No.: 530,902

[22] Filed: Sep. 20, 1995

[51] Int. Cl.[6] ..... D05B 41/00; D05B 33/00

[52] U.S. Cl. ..... 112/470.36

[58] Field of Search ..... 112/470.28, 470.29, 112/470.36, 217.1, 260, 11, 10; 414/226, 225; 271/175

[56] References Cited

U.S. PATENT DOCUMENTS

| | | | |
|---|---|---|---|
| 3,537,702 | 11/1970 | Kosrow et al. | 112/470.36 X |
| 3,701,328 | 10/1972 | Frost | 112/470.36 |
| 3,788,248 | 1/1974 | Marforio . | |
| 3,865,058 | 2/1975 | Rovin et al. . | |
| 4,615,288 | 10/1986 | Matsuda | 112/470.36 |
| 4,624,615 | 11/1986 | Russell et al. . | |
| 4,664,367 | 5/1987 | Vergnetti | 112/470.36 X |
| 5,018,463 | 5/1991 | Nakajima | 112/470.36 |
| 5,109,781 | 5/1992 | Sasamoto . | |
| 5,255,621 | 10/1993 | Schramayr et al. . | |

*Primary Examiner*—Ismael Izaguirre

[57] ABSTRACT

An automatic unloading and stacking apparatus and method for automatic unloading and stacking tubular articles from a circular sewing system. The system includes a mechanism for clamping and removing sewn garments from a circular sewing station that does not interfere with an operator's ability to access the sewing station. Once removed from the sewing machine, the sewn garments are then stacked in a remote location allowing an operator to load the next garment to be sewn.

22 Claims, 9 Drawing Sheets

S
10
30
S2
S1
31
G
100
CPU
33
14
14'
12
13
13'
112
110
50
15
11
113
111
16
52
51
17
53
53
18
18

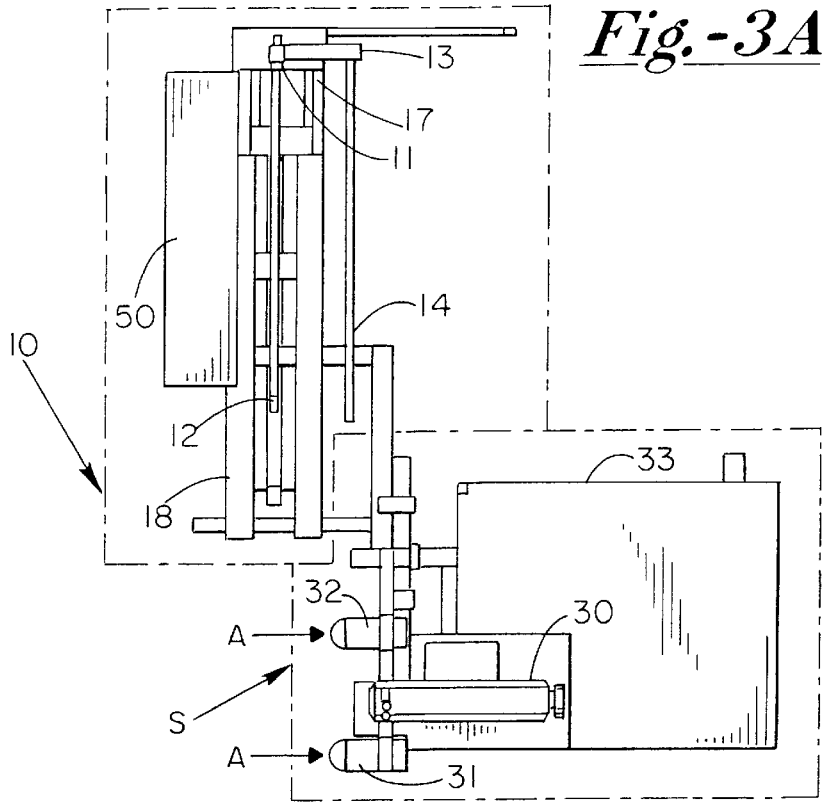
Fig.-3A
Fig.-3B
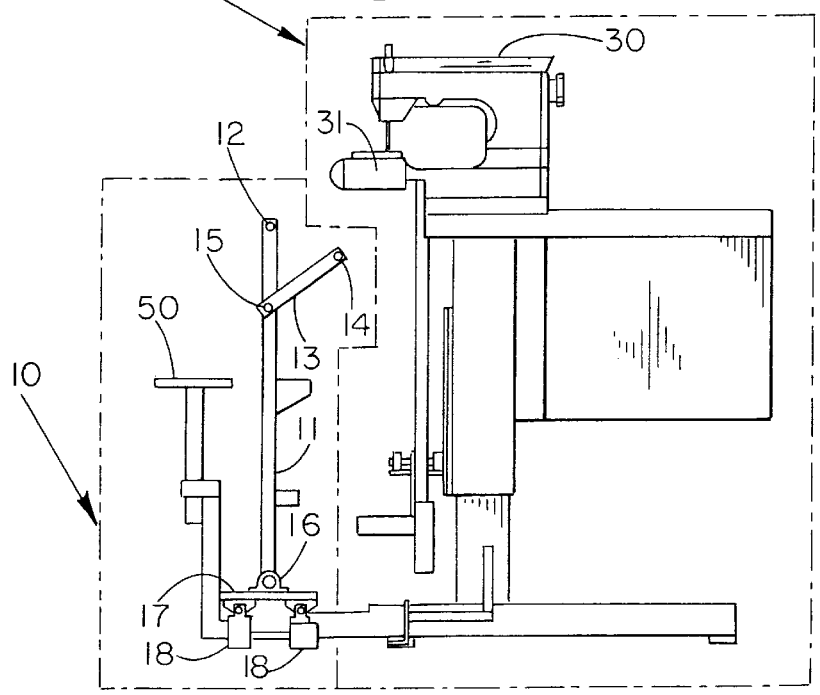

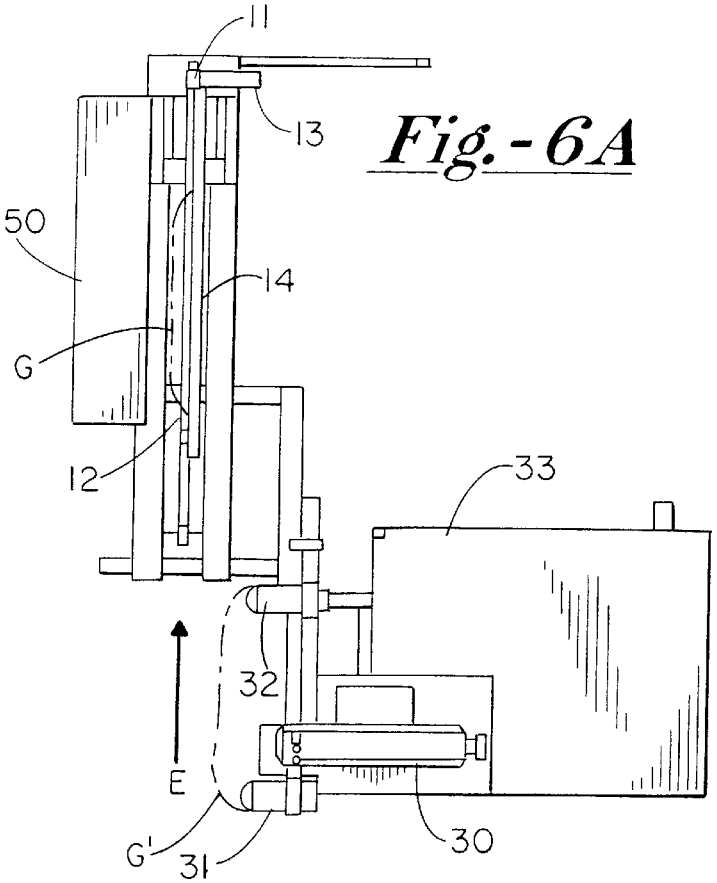
Fig.-6A
Fig.-6B
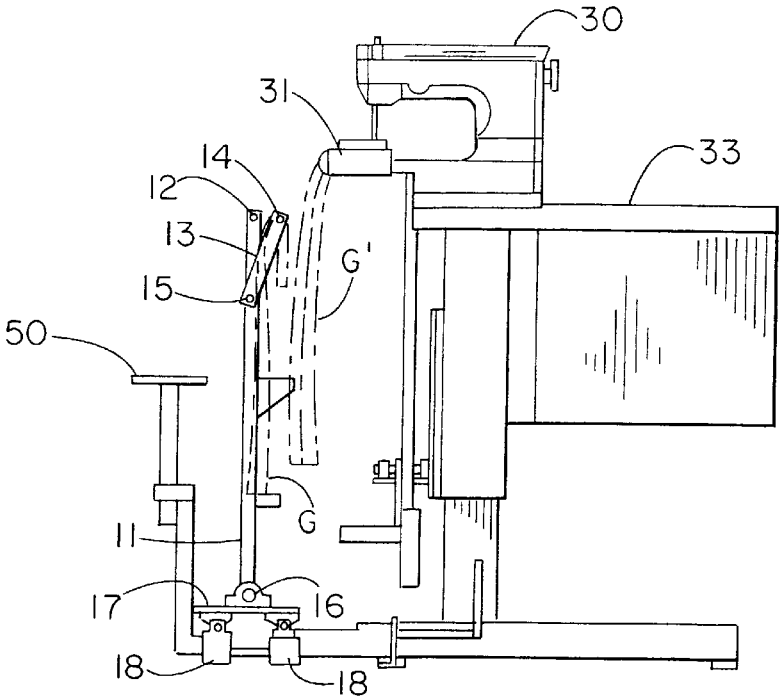

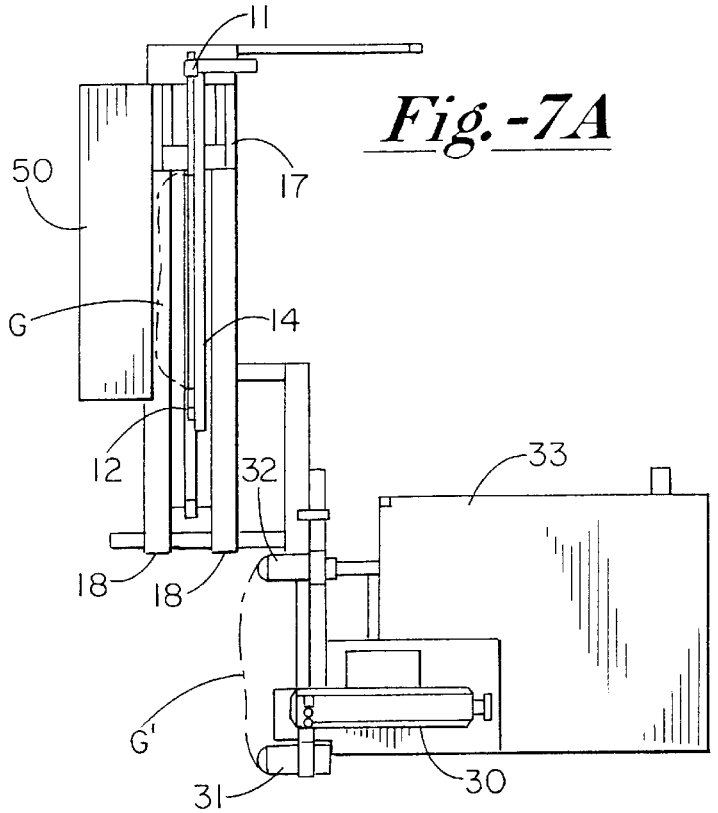
Fig.-7A
Fig.-7B
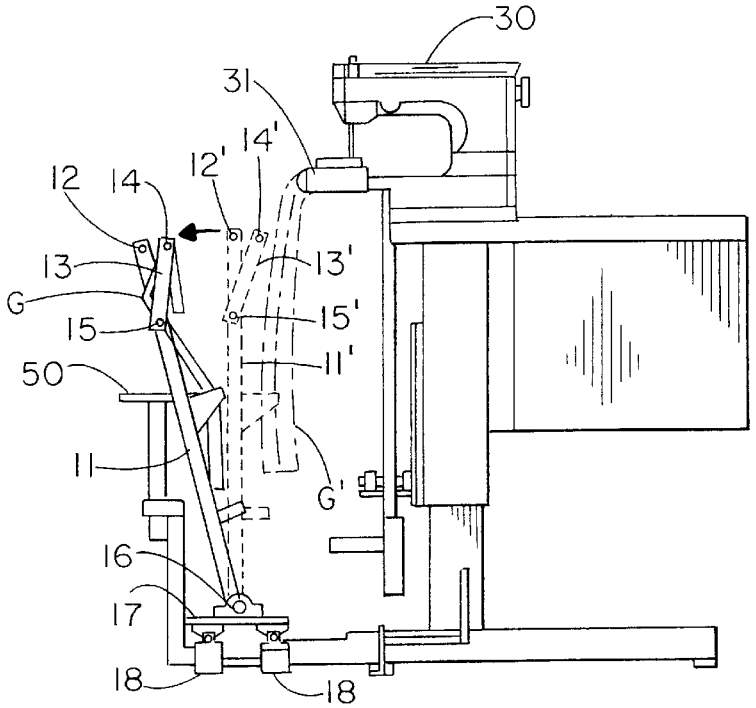

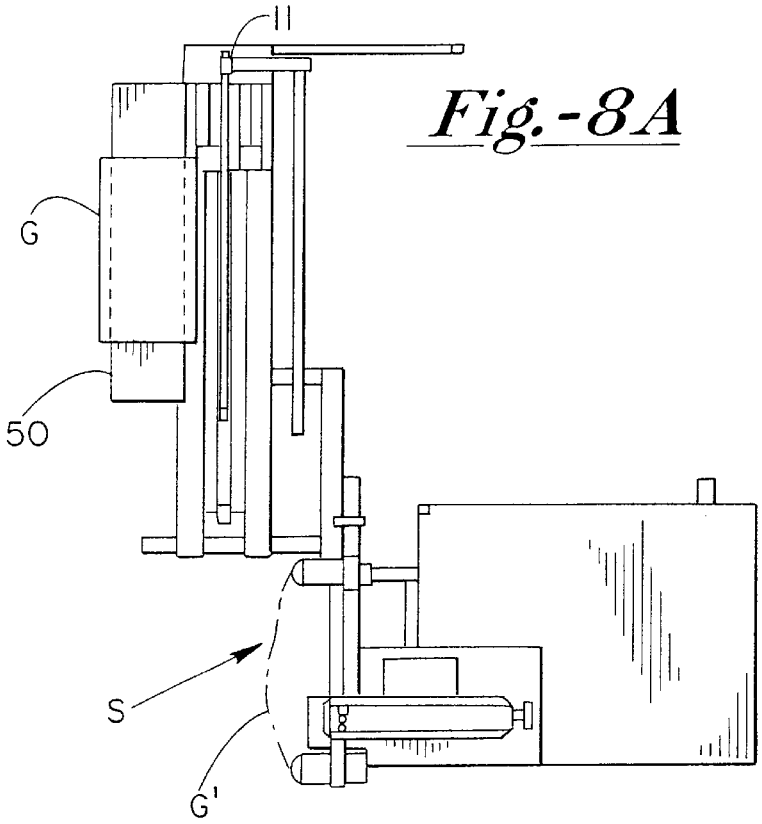
Fig.-8A
Fig.-8B
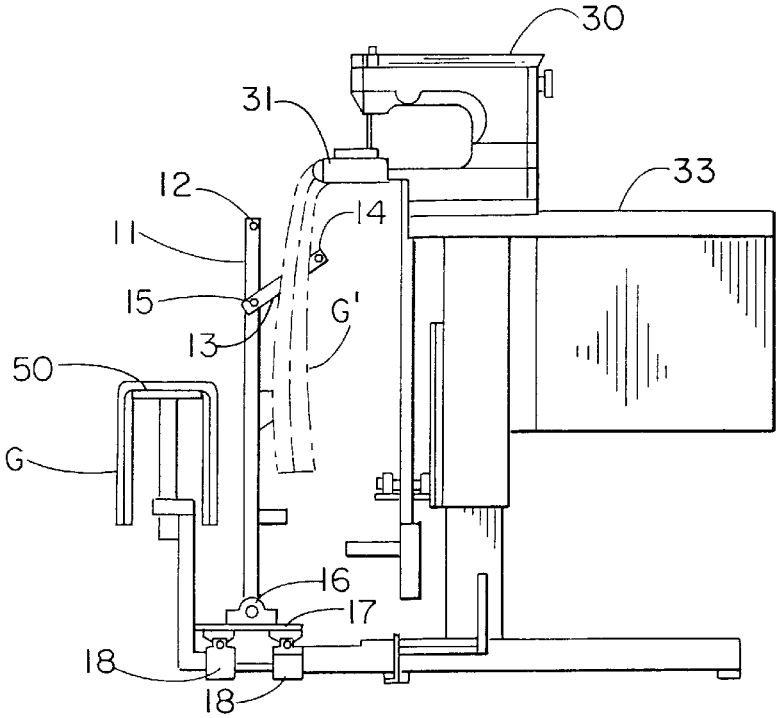

AUTOMATIC UNLOADING AND STACKING APPARATUS

BACKGROUND OF THE INVENTION

1. Field of the Invention

This invention relates to an automatic unloading and stacking apparatus for unloading and stacking tubular articles from a circular sewing system.

2. Description of Background Art

Conventional automatic unloading and stacking devices used to unload tubular garments from an automatic sewing machine operate in the area immediately in front of the sewing equipment. This is the same area that an operator must occupy in initially loading the garment onto the automatic sewing machine. As a result, conventional unloading systems decrease the efficiency of the sewing process and unduly hinders the operator's ability to use the sewing machine by requiring the operator to work around the unloading system.

U.S. Pat. No. 3,865,058 issued to Rovin et al., discloses one conventional type of front unloading stacker device. In this device, a sewing station for sewing tubular articles is disclosed as having a pair of tensioning drums around which the tubular article is rotated during a sewing operation. The device further includes an extender bar having a pair of elongated rods supporting a transversely disposed bar at their forward ends. In its retracted position, the extended bar assembly is positioned so that the cross-bar lies directly in front of the drums extending therebetween. When the sewing operation has been completed and the side seam properly relocated the sewn article can be ejected from the sewing machine by activating the extender bar assembly to project a cross-bar in a forward direction. When the extender is actuated, the cross-bar engages the bottom of the sewn article and carries it outward to withdraw the article from the supporting drums. When the extender bar has been fully projected, it comes into range of a pair of gripping jaws of a folder stacker assembly. The jaws are actuated to close lightly and to engage the end of the sewn article. Both the extender bar and the folder stacker are then actuated in a retracting direction. The completed sewn article is then released by the folder stacker and draped over a stacking bar.

The above conventional unloading and stacking device has at least two distinct disadvantages. First, the automatic unloading and stacking system interferes with the loading operation since it is necessary for the unloading and stacking process to be completed before another article to be sewn can be loaded onto the sewing station. Second, because of the configuration of the unloading system, an operator must stand clear of the front of the sewing station during the unloading process. Each of these disadvantages result in the operator having to load workpieces on the equipment using ergonomically unsound motions in order to avoid the unloading system. Current systems do not address these problems.

OBJECTS AND SUMMARY OF THE INVENTION

The present invention relates to a method and apparatus disclosed for the automatic unloading and subsequent stacking of tubular articles such as sweat pants, T-shirts, pillowcases, etc., which are sewn in a circular fashion provided with a top or bottom sewn edge.

It is an object of the present invention to provide an automatic unloading and stacking apparatus which is capable of unloading and stacking a sewn article without interfering with a subsequent loading operation of the sewing station.

Another object of the present invention is to provide an automatic unloading and stacking apparatus that allows an operator of the system to load the sewing station in an ergonomically sound position.

A further object of the present invention is to provide an automatic unloading and stacking apparatus which decreases the cycle time and increases the efficiency of an automatic sewing process.

These and other objects of the present invention are accomplished by an apparatus for unloading and stacking an article which is sewn at a sewing station, said sewing station having a front direction from which an operator inserts an article which is to be sewn, said apparatus comprising a reciprocating base member which approaches said sewing station from a side direction which is approximately perpendicular to said front direction; a pair of stack bars including a stationary stack bar and a clamping stack bar disposed in parallel with each other, said clamping stack bar being movable toward and away from said stationary stack bar; and support means for pivotally supporting said pair of stack bars, said support means being pivotally mounted to said reciprocating base member; wherein in operation said base member beginning in a home position away from said sewing station and during a sewing operation said base member and said pair of stack bars move toward the article such that one of said stack bars is on one side of the article and the other of said stack bars in on an opposite side of said article, said stack bars closing on said article thereby pinching the article between them, said support means being pivoted away from the sewing station in a manner that removes the article from the sewing station, and said base member moves away from said sewing station and returns to said home position where said stack bars position the article over a rest member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 3A and 3B are top and side views, respectively, of a circular sewing station with an automatic unloading and stacking apparatus, with the stacking apparatus shown in a home position;

FIGS. 6A and 6B are top and side views, respectively, of a circular sewing station with an automatic unloading and stacking apparatus, where the clamping arms which are supporting the garment are returned to the home position;

FIGS. 7A and 7B are top and side views, respectively, of a circular sewing station having an automatic unloading and stacking apparatus, which illustrate the garment G being draped over a material rest bar;

FIGS. 8A and 8B are top and side views, respectively, of a circular sewing station with an automatic unloading and stacking apparatus, where the garment G is shown draped over a rest bar and clamping bars are returned to their home position.

DETAILED DESCRIPTION OF THE PREFERRED EMBODIMENTS

Figure 1:
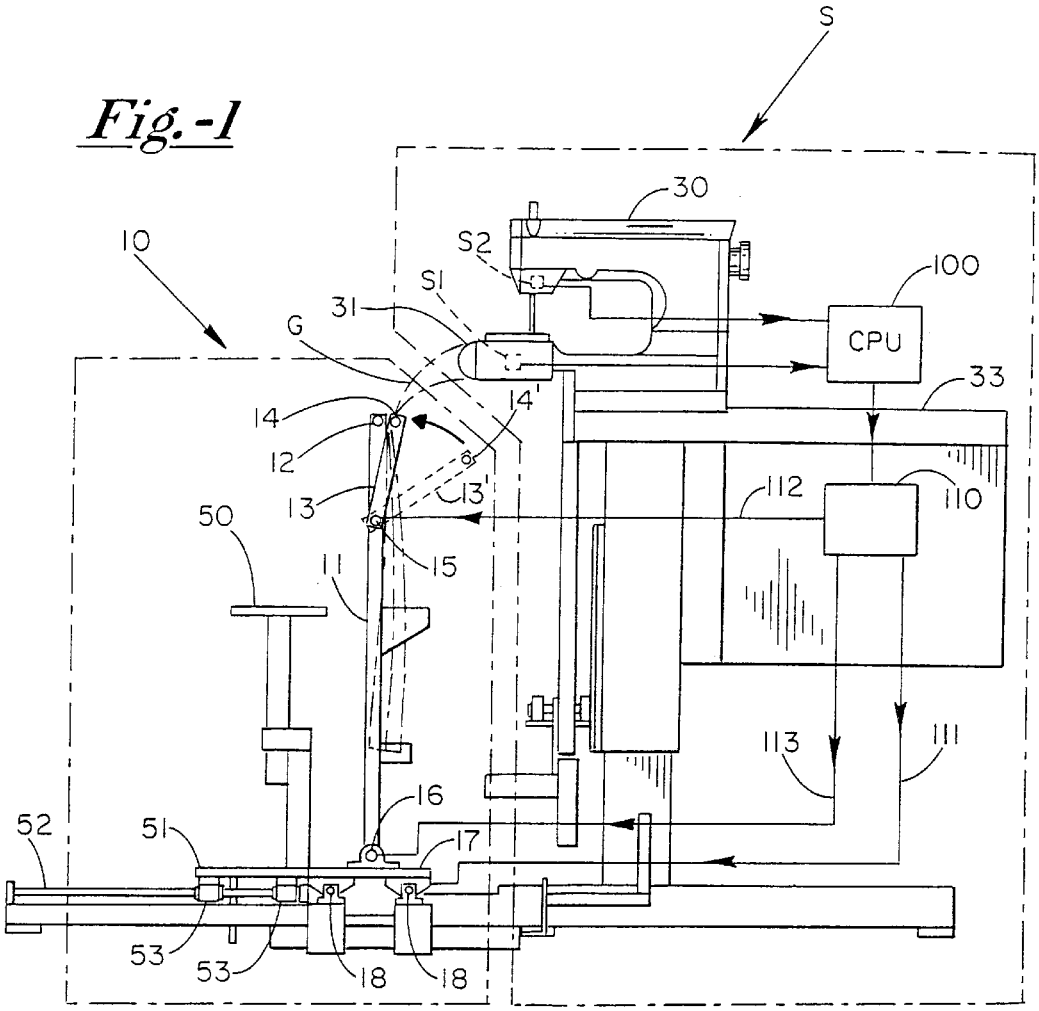
FIG. 1 is a side view of a circular sewing station with an automatic unloading and stacking apparatus according to a preferred embodiment of the present invention.

Referring in detail to the drawings and with particular reference to FIG. 1, an automatic unloading and stacking apparatus 10 is shown in combination with a sewing station S.

Figure 4A:
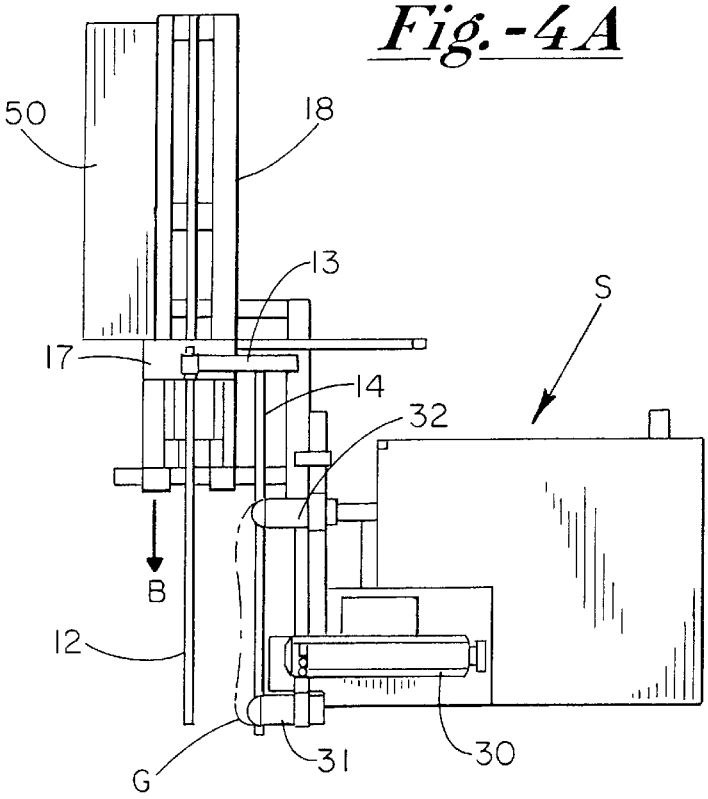
FIGS. 4A and 4B are top and side views, respectively, of a circular sewing station with an automatic unloading and stacking apparatus, where the apparatus is in a clamping position.
Figure 5A:
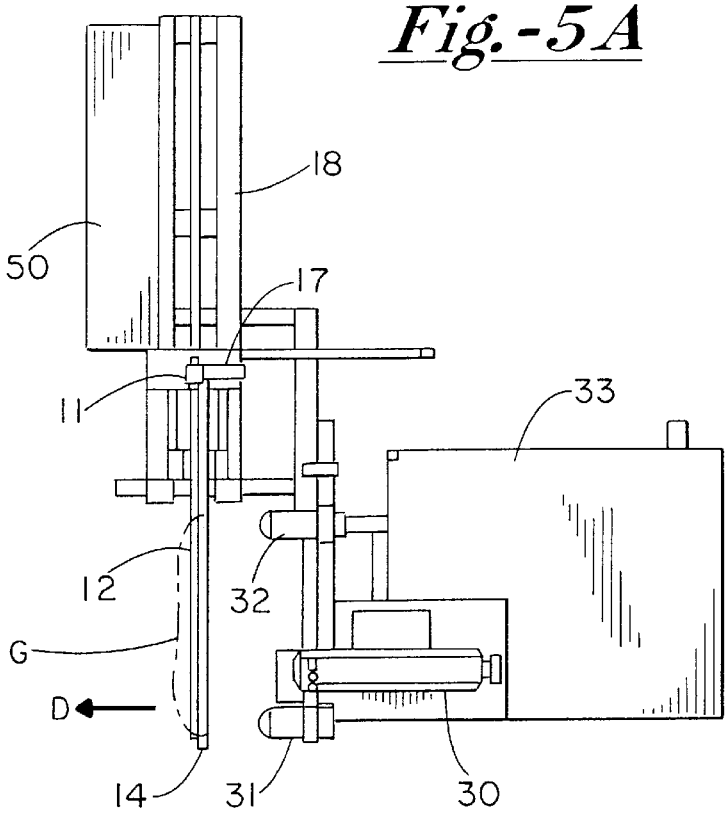
FIGS. 5A and 5B are top and side views, respectively, of a circular sewing station wit an automatic unloading and stacking apparatus, where the apparatus is moved to an unloading position.

The unloading and stacking device 10 (distinguished by a first set of phantom lines in FIG. 1) includes a pivot arm 11 which supports a stationary stack bar 12 at a top portion thereof. A clamping arm 13 is pivotally attached to the pivot arm 11 by means of a clamping arm pivot pin 15. The clamping arm 13 supports at one end thereof a clamping stack bar 14. The pivot arm 11 is supported at a lower end thereof by a pivot pin 16 which is mounted to a slidable base member 17. The slidable base member 17 is disposed on a pair of rails 18 on which the slidable base member 17 reciprocates from a home position as shown in FIG. 2 to a second position as shown in FIGS. 4A and 5A.

The sewing station S (distinguished by a second set of phantom lines in FIG. 1) includes a sewing machine 30. As shown in FIG. 2, a pair of tensioning rollers 31,32 are provided for supporting a garment G during a sewing operation. The sewing machine 30 is provided on a base 33.

Figure 2:
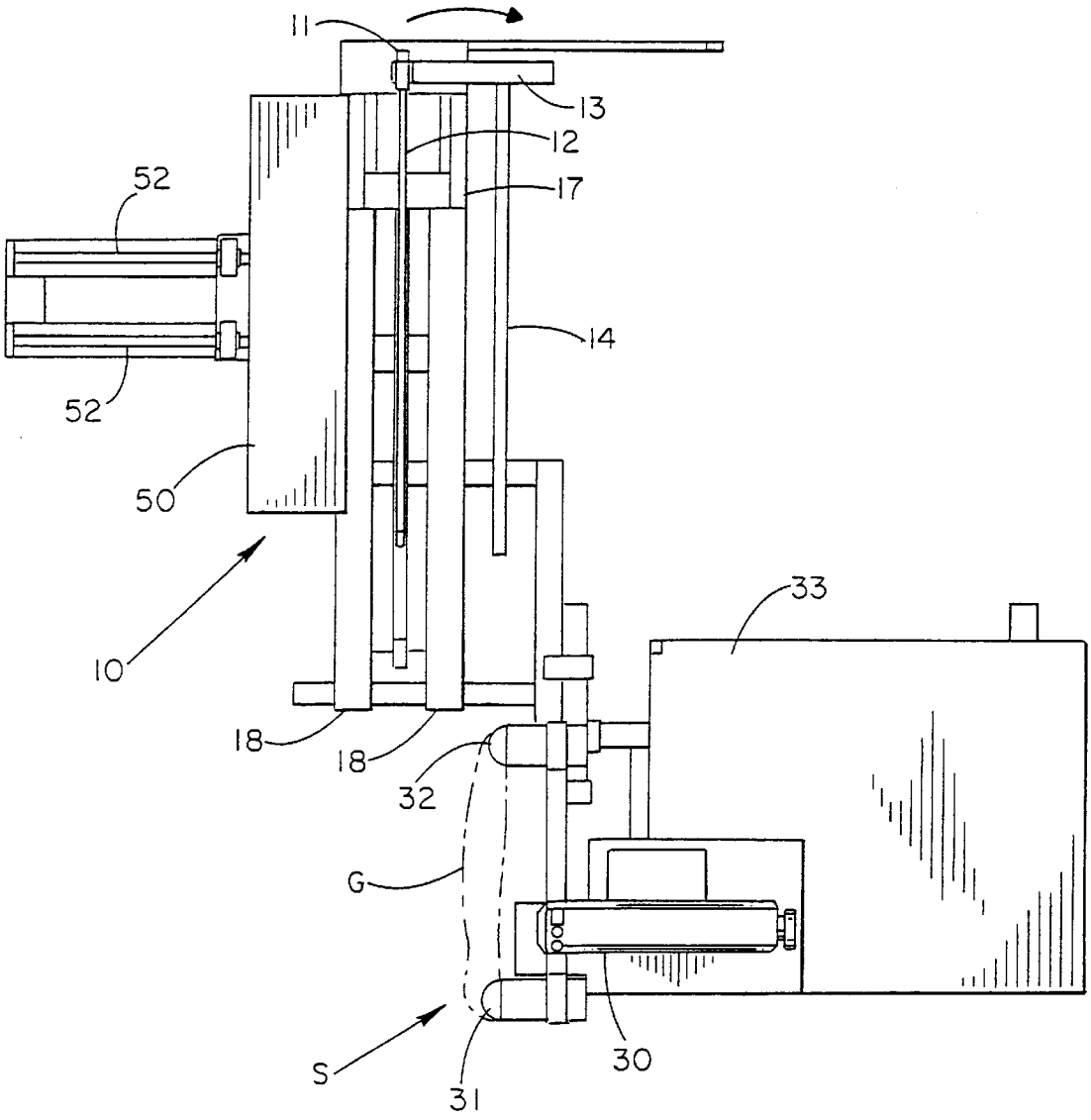
FIG. 2 is a top view showing of a circular sewing station with an automatic unloading and stacking apparatus according to a preferred embodiment of the present invention.

As shown in FIGS. 1 and 2, a material rest bar 50 is provided on a slidable rest bar base member 51. The slidable rest bar base member 51 is provided with sliders 53 which slide along rails 52 between a home position and loading position. In the home position, the material rest bar 50 and slidable rest bar base member 51 are spaced from pivot arm 11 so as not to interfere with movement of the pivot arm 11 (and other associated elements) with respect to the sewing station 30. However, once the stacking and unloading device 10 has clamped a garment and returned from the sewing station 10, the material rest bar 50 and slidable rest bar base member 51 move toward and under an advancing pivot arm 11 as it drapes the clamped garment over the material rest bar 50 and ultimately releases the garment.

The operation of a preferred embodiment of the present invention will be described hereinafter with specific reference to FIGS. 3A,3B through 8A,8B.

In FIGS. 3A and 3B, the automatic unloading and stacking device 10 is shown with the base member 17 in a home position. The clamping arm 13 is open such that the clamping stack bar 14 is disposed in a position spaced from the stationary stack bar 12. The pivot arm 11 is in a substantially vertical position. The areas represented by phantom lines generally illustrate the interaction between the automatic unloading and stacking device 10 and the sewing station S.

As shown in FIG. 3A, the automatic unloading and stacking device 10 is disposed in a position to one side of the sewing station S outside the area immediately in front of the machine. A garment (such as shown in FIG. 1) is loaded on the sewing station tensioning rollers 31,32 from a sewing station front direction as illustrated by arrows A. With the slidable base member 17 in its home position as shown in FIG. 3A, the automatic unloading and stacking device 10 does not interfere with a sewing station loading operation.

Figure 4B:
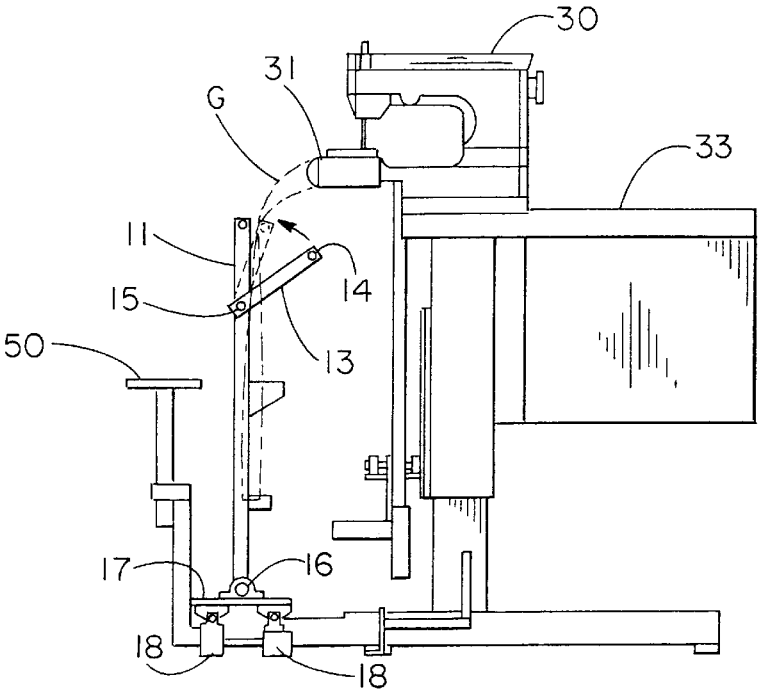

With reference to FIGS. 4A and 4B, a garment G is shown as loaded on the tensioning roller 31,32 of the sewing station S. After a sewing operation has commenced, the slidable base member 17 of the automatic unloading and stacking apparatus 10, is moved in the direction of arrow B (See FIG. 4A) from the home position to a second position. While the slidable base member 17 is moved in the direction of arrow B, the clamping stack bar 14 moves behind the garment G while the stationary stack bar 12 moves in front of the garment G placing the garment G in between so that it enters the open area between the clamping stack bar 14 and the stationary stack bar 12.

When the sewing sequence has been completed, the clamping arm 13 moves to a closed position in the direction of arrow C, as shown in FIG. 4B. In the closed position, the garment G is pinched between the stationary stack bar 12 and the clamping stack bar 14. The pivot arm 11 is still maintained in a substantially vertical position.

Figure 5B:
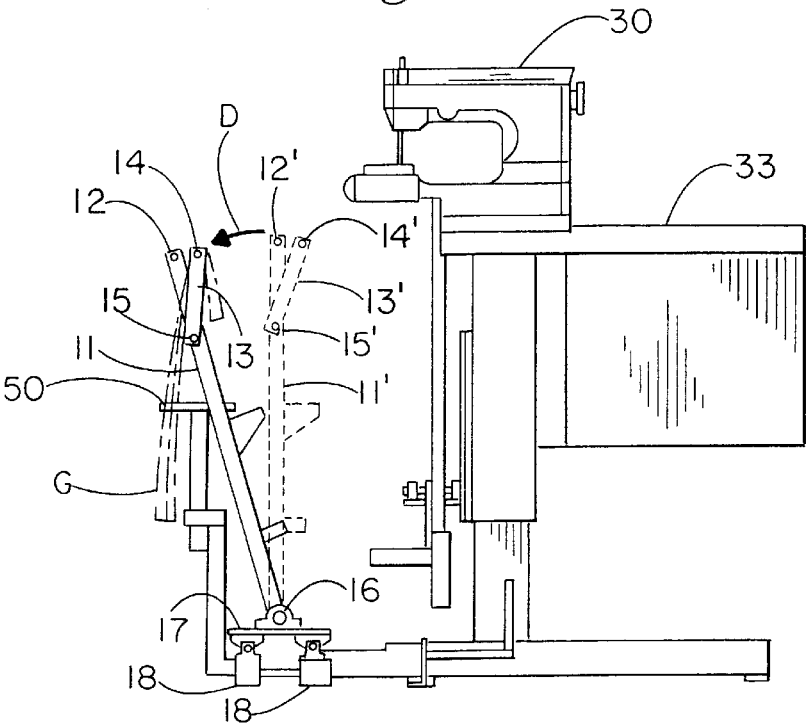

FIGS. 5A and 5B illustrate the unloading process. As shown in FIG. 5B, the garment G which is pinched between the stationary stack bar 12 and the clamping stack bar 14 is pulled off of the tensioning rollers 31,32 of the sewing station S by rotation of the pivot arm 11 in the direction of arrow D. When the garment G is released from the tensioning rollers 31,32, it drapes over the clamping stack bar 14 and remains pinched between the clamping stack bar 14 and the stationary stack bar 12. The pivot arm 11 is then returned to its vertical position as illustrated by the phantom line depiction of the pivot arm 11'.

With reference to FIGS. 6A and 6B, the slidable base member 17 of the automatic unloading and stacking apparatus 10 moves in the direction of arrow E and returns to its home position, away from the sewing station. This allows an operator to load the next garment G without having to wait for the completion of the stacking sequence.

The slidable base member 17 returns to the home position, the pivot arm 11 is in the vertical position, and the garment G remains clinched between the stationary stack bar 12 and the clamping stack bar 14. Another garment G' is also shown as loaded onto the sewing station S while the stacking operation is underway.

FIGS. 7A and 7B illustrate the stacking operation. As shown in FIG. 7A, the slidable base member 17 is in the home position and the garment G is clamped between the stationary stack bar 12 and the clamping stack bar 14. In order to perform the stacking operation, the pivot arm 11 is rotated in the direction of arrow F, as shown in FIG. 7B. The garment G is then positioned over the material rest bar 50 as it moves toward the rotating pivot arm 11. At this time, the clamping arm 13 is moved to its open position, thereby moving the clamping stack bar 14 away from the stationary stack bar 12 and releasing the garment G, and leaving it to drape over the material rest bar 50.

With reference to FIGS. 8A and 8B, the pivot arm 11 has returned to its vertical position, the slidable base member 17 is still in its home position, the clamping arm 13 is in its open position, and the garment G is draped over the material rest bar 50. Once the pivot arm 11 has returned to its vertical position, the slidable base member can return to its home position at any time prior to movement of the pivot arm 11 toward the sewing station S.

During the stacking procedure, the sewing station has already commenced sewing another garment G'. During the sewing operation, the slidable base member 17 of the automatic unloading and stacking device 10 is again moved to its second position in order to begin another cycle of the unloading and stacking apparatus.

Figure 9:
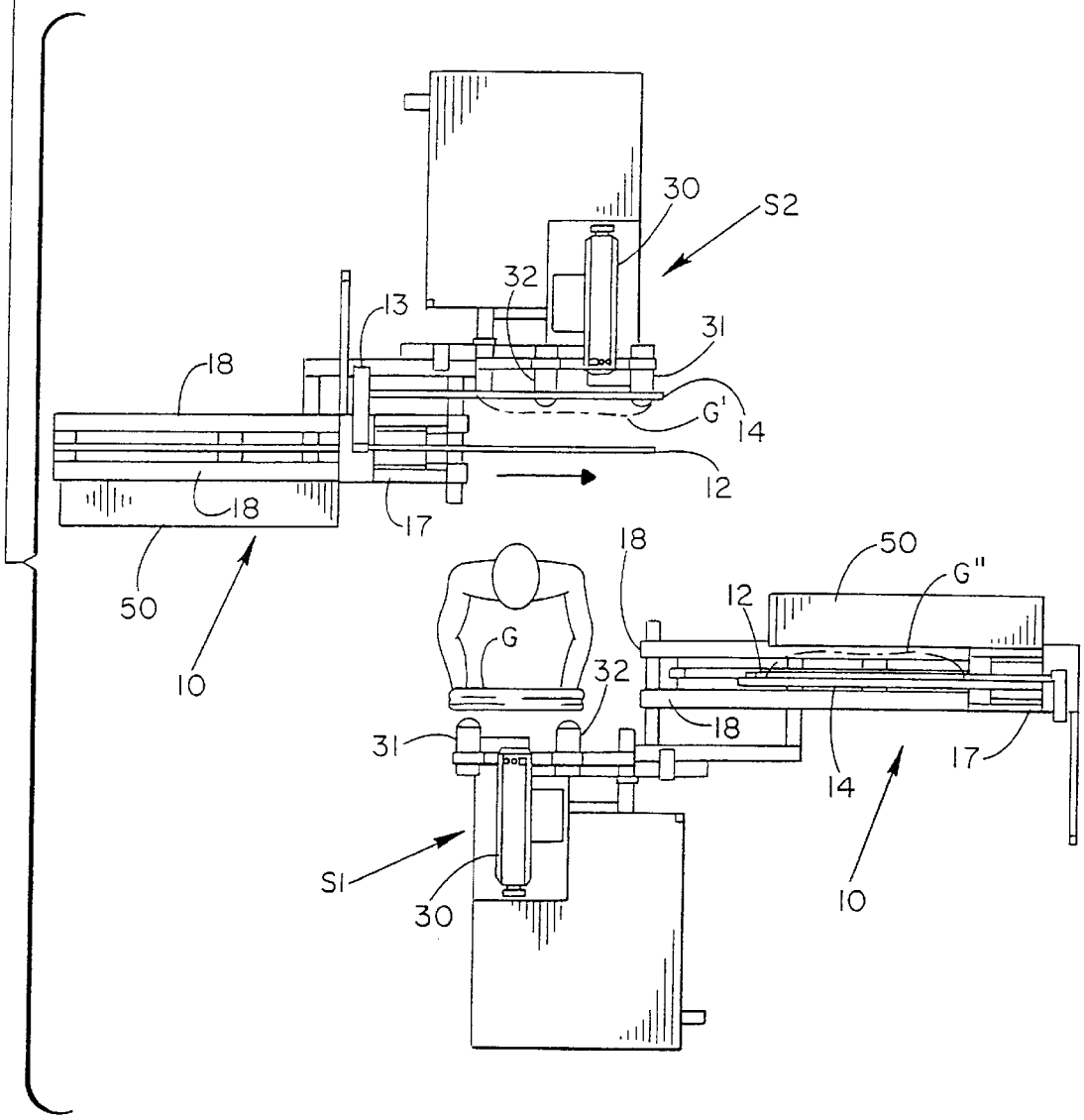
FIG. 9 is a top view of a circular sewing system with two circular sewing stations each provided with an automatic unloading and stacking apparatus.

As shown in FIG. 9, the disclosed unloading system may be used with a single or multiple sewing stations. An automatic circular sewing system is shown having two sewing stations S1,S2 disposed adjacent to each other with an operator therebetween. The operator loads a garment G onto the sewing station S1, while the automatic unloading and stacking apparatus 10 associated with the sewing station S2 is preparing to unload the garment G' loaded thereon. In this way, the operator can load one sewing station while the other sewing station is executing a sewing process. Also, while the operator is loading a garment G onto the sewing station S1, the automatic unloading and a stacking device 10 associated with the sewing station S1 is preparing to stack the garment G' over the material stack bar 50. It is noted that more than two sewing stations could be operated by a single operator. With this arrangement, an operator can effectively load two sewing systems by moving within an area of approximately ninety degrees (90°). In addition, the sewing stations could be oriented differently than shown in FIG. 9.

Referring again to FIG. 1, it is noted that the movement of the clamping arm 13 can be carried out by hydraulic, pneumatic, electric servomotor, or equivalent means. Likewise, the movement of the pivot arm 11 about the pivot pin 16 can also be carried out by hydraulic, pneumatic, electric servomotor or equivalent means. Furthermore, the movement of slide base member 17 or slidable rest bar base member 51 can also be carried out by hydraulic, pneumatic, electric servomotor or equivalent means.

For purposes of illustrating the control system for the present invention, a pneumatic system 110 is used for operating the automatic unloading and stacking apparatus 10. The control system of the present invention includes a sensor S1 for determining when a garment is loaded onto the tensioning rollers 31,32 and for determining when a garment is unloaded from the tension rollers 31,32. An additional sensor S2 is provided on the sewing machine 30, for detecting the number of stitches performed on each garment. As the sensor S2 detects a predetermined number of stitches, the CPU 100 delivers a signal to the pneumatic control system 110 to move the slidable base member 17 from the home position to the second position, via pneumatic line 111.

When the sensor S2 detects a second predetermined number of stitches, representing completion of the stitching operation, the sewing machine is turned off. At this time, the control unit 100 sends a signal to the pneumatic control unit 110 to move the clamping arm 13 to a closed position via pneumatic line 112, thereby clamping the garment G between the stationary stack bar 12 and the clamping stack bar 14. The control unit 100 then sends a signal to the pneumatic control unit 110 to pivot the pivot arm 11 via pneumatic line 113, so as to unload the garment G from the tension roller 31,32. At this time, if the sensor S1 does not indicate that the garment has been removed, an error message is sent by the control unit 100 to stop the unloading procedure. The operator would then manually unload the garment G and restart the system.

If the sensor S1 indicates that the garment G is properly removed from the tension roller 31,32, the control unit 100 instructs the pneumatic control unit 110 to return the pivot arm to the vertical position via pneumatic line 113. The pneumatic control unit 110 is also instructed to return the slide base member 17 to the home position via pneumatic line 111.

After the slidable base member is returned to the home position, the pneumatic control unit 110 is instructed to pivot the pivot arm 11 in order to drape the garment over the material rest bar via pneumatic line 113. The pneumatic control unit 110 is then instructed to pivot the clamping arm 13 to an open position via pneumatic line 112, in order to release the garment over the material rest bar 50. The pneumatic control unit 110 is then instructed to return the pivot arm 11 to the vertical position via pneumatic line 113.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for unloading and stacking an article which is sewn at a sewing station, said sewing station having a front direction from which an operator inserts an article which is to be sewn, said apparatus comprising:

a reciprocating base member which approaches said sewing station from a side direction which is approximately perpendicular to said front direction;

a pair of stack bars including a stationary stack bar and a clamping stack bar disposed in parallel with each other, said clamping stack bar being movable toward and away from said stationary stack bar; and support means for pivotally supporting said pair of stack bars, said support means being pivotally mounted to said reciprocating base member;

wherein in operation said base member begins in a home position away from said sewing station and during a sewing operation said base member and said pair of stack bars move toward the article such that one of said stack bars is on one side of the article and the other of said stack bars is on an opposite side of said article, said stack bars closing on said article thereby pinching the article between them, said support means being pivoted away from the sewing station in a manner that removes the article from the sewing station, and said base member moves away from said sewing station and returns to said home position where said stack bars position the article over a rest member.

2. The apparatus according to claim 1, wherein said reciprocating base member is disposed on a track on which said base member reciprocates.

3. The apparatus according to claim 1, wherein one of said pair of stack bars is provided at a first end portion of said support means and the other of said pair of stack bars is pivotally mounted on said support means by way of an intermediate pivot arm.

4. The apparatus according to claim 1, wherein when said reciprocating base member is at said home position, an article which is clamped between said pair of stack bars is positioned over a stationary rest bar as said support means is pivoted to cause said pair of stack bars to pass over said stationary rest bar where said clamping stack bar is moved away from said stationary stack bar to thereby release said article.

5. An apparatus according to claim 1, further comprising actuating means for reciprocating said base member, moving said clamping stack bar, and pivoting said support means.

6. An apparatus for unloading and stacking an article which is sewn at a sewing station, said sewing station having a front direction from which an operator inserts an article which is to be sewn, said apparatus comprising:

a reciprocating base member linearly movable from a home position to an unloading position, said home position being disposed in a side direction of said sewing station which is approximately perpendicular to said front direction;

a pair of stack bars including a stationary stack bar and a clamping stack bar disposed in parallel with each other, said clamping stack bar being movable toward and away from said stationary stack bar, one of said pair of stack bars being positioned on a first side of an article which is being sewn, and the other of said pair of stack bars being disposed on an opposite side of said article when said reciprocating base member is in said unloading position; and support means for pivotally supporting said pair of stack bars, said support means being pivotally mounted to said reciprocating base member.

7. The apparatus according to claim 6, wherein said reciprocating base member is disposed on a track on which said base member reciprocates.

8. The apparatus according to claim 6, wherein one of said pair of stack bars is provided at a first end portion of said support means and the other of said pair of stack bars is pivotally mounted on said support means by way of an intermediate pivot arm.

9. The apparatus according to claim 6, wherein when said reciprocating base member is at said home position, an article which is clamped between said pair of stack bars is positioned over a stationary rest bar as said support means is pivoted to cause said pair of stack bars to pass over said stationary rest bar where said clamping stack bar is moved away from said stationary stack bar to thereby release said article.

10. The apparatus according to claim 6, further comprising actuating means for reciprocating said base member, moving said clamping stack bar, and pivoting said support means.

11. A method for unloading and stacking an article which is sewn at a sewing station, said sewing station having a front direction from which an operator inserts an article which is to be sewn, said method comprising the steps of:

providing a reciprocating base member which approaches said sewing station from a side direction which is approximately perpendicular to said front direction;

providing a pair of stack bars including a stationary stack bar and a clamping stack bar disposed in parallel with each other, said clamping stack bar being movable toward and away from said stationary stack bar;

providing support means for pivotally supporting said pair of stack bars, said support means being pivotally mounted to said reciprocating base member;

moving said base member and said pair of stack bars from a home position, to said sewing station is on one side of the article and the other of said stack bars is on an opposite side of said article during a sewing operation;

closing said stack bars on said article thereby pinching the article between them;

pivoting said support means away from the sewing station in a manner that removes the article from the sewing station; and moving said base member away from said sewing station to said home position where said stack bars position the article over a rest member.

12. An apparatus for unloading an article from a circular sewing machine having a reference plane defined by a work supporting surface, said circular sewing machine having a front direction from which an operator loads an article to be sewn and a loading position normally occupied by an operator when loading an article on the circular sewing machine, the apparatus comprising:

means for engaging and removing a loaded article from the circular sewing machine; and moving means for transporting the engaging and removing means toward the circular sewing machine from a side direction into engagement with a loaded article along a predetermined path below the reference plane and that does not traverse the loading position of the circular sewing machine so that an operator may remain in the loading position when a loaded article is being removed.

13. The apparatus according to claim 12, wherein said engaging and removing means include a pair of clamping members which define a v-shaped opening therebetween for receiving a loaded article.

14. The apparatus according to claim 13, wherein said moving means transports the engaging and removing means in a direction substantially perpendicular to the front direction of said circular sewing machine such that one of said clamping members is disposed in front of said article and the other of said clamping member is disposed behind said article.

15. The apparatus according to claim 12, wherein said moving means transports said removing means in a direction substantially perpendicular to the front direction of said sewing machine.

16. The apparatus according to claim 12, further comprising:

means for stacking an article removed from said circular sewing machine by said engaging and removing means.

17. The apparatus according to claim 16, wherein said removing means includes a pair of clamping members which define a v-shaped opening therebetween for receiving a loaded article.

18. The apparatus according to claim 17, wherein the predetermined path of said moving means is in a direction substantially perpendicular to a front direction of said sewing machine.

19. An apparatus for unloading and stacking an article from a sewing machine having a reference plane defined by a work supporting surface and a loading position normally occupied by an operator when loading an article on the sewing machine, the apparatus comprising:

removing means for engaging and removing a loaded article from the sewing machine;

moving means for moving the removing means from a home position to a clamping position into engagement with an article on the sewing machine along a predetermined path below the reference plane and that does not traverse the loading position of the sewing machine so that an operator may remain in the loading position when the removing means is in the claiming position; and means for stacking an article unloaded by the removing means from said sewing machine.

20. A method for unloading an article from a sewing machine, said sewing machine having below the reference plane and a front direction from which an operator loads an article to be sewn and a loading position normally occupied by an operator when loading an article on the sewing machine, the method comprising the steps of:

moving a clamping device toward the sewing machine from a side direction into engagement with a loaded article along a predetermined path below the reference plane and that does not traverse the loading position of the sewing machine so that an operator may remain in the loading position when a loaded article is being removed; and engaging and removing a loaded article from the sewing machine with said clamping device.

21. The method according to claim 20, wherein said moving step comprises positioning the clamping device around a loaded article, the clamping device including a pair of clamping members which define a v-shaped opening therebetween, from a side direction that is substantially perpendicular to a front direction of said sewing machine such that one of said clamping members is disposed on a first side of the loaded article and the other of said clamping members is disposed on an opposite side of the loaded article.

22. The method according to claim 20, further comprising:

stacking an article after said engaging and removing step.

* * * * *